US005743248A

United States Patent [19]

Jansen, Jr.

[11] Patent Number: 5,743,248

[45] Date of Patent: Apr. 28, 1998

[54] PORTABLE FUSED CAMPFIRE

[76] Inventor: Herman W. Jansen, Jr., 206 Pear St., Damiansville, Ill. 62215

[21] Appl. No.: 748,576

[22] Filed: Nov. 13, 1996

[51] Int. Cl.[6] ..... C10L 11/00

[52] U.S. Cl. ..... 126/25 B; 126/25 R; 44/519; 44/533; 44/535

[58] Field of Search ..... 126/500, 25 R, 126/25 B, 9 A; 44/541, 530, 531, 532, 533, 534, 535, 519

[56] References Cited

U.S. PATENT DOCUMENTS

| | | | |
|---|---|---|---|
| 308,178 | 11/1884 | Leduc | 44/541 |
| 489,237 | 9/1893 | Cutrara . | |
| 2,811,428 | 10/1957 | Smith | 126/25 B |
| 3,575,156 | 4/1971 | Hosford | 126/25 |
| 4,063,904 | 12/1977 | Beeson | 44/40 |
| 4,627,854 | 12/1986 | Pratt | 44/40 |
| 5,050,738 | 9/1991 | McAdams . | |
| 5,186,721 | 2/1993 | Campana | 44/519 |

*Primary Examiner*—Carl D. Price
*Attorney, Agent, or Firm*—Don W. Weber

[57] ABSTRACT

A portable, fused essentially waterproof campfire is presented. The campfire has a trapezoidal cross-section with kindling, a firestick and a fuse located near the bottom center of the trapezoid. The fuse runs from the firestick to the outside of the campfire. Surrounding the firestick and kindling are increasingly larger sizes of wood, ranging from one inch in diameter to approximately 5 inches in diameter at the top. The campfire, once constructed, is entirely surrounded by a clear combustible material such as shrink wrap and a handle is attached. The shrink wrap not only keeps the campfire in its trapezoidal shape, it also keeps water from penetrating. The campfire is highly portable and easily started even under damp conditions. One simply lights the fuse, which ignites the firestick and kindling and the rest of the fire.

6 Claims, 2 Drawing Sheets

PORTABLE FUSED CAMPFIRE

BACKGROUND OF THE INVENTION

This invention relates to the field of camping and picnic supplies. More particularly, it discloses a unique fused, self-contained, portable and highly efficient campfire.

In the field of camping and outdoor activities, the campfire is one of the most fundamental necessities. Although campers frequently use tents, gas stoves, electric heaters, and other means for keeping warm or cooking food, the standard campfire is popular throughout the United States and the World. Different devices have been produced that are designed to either cook the food of the camper or to keep the camp warm during the evening hours, or both. For example, gas-fueled portable stoves are known in the art as are various types of portable heating devices. Campfires of differing designs and uses are also known in the art.

One such portable, pre-packaged fire and barbecue is disclosed in the 1971 patent issued to Hosford, U.S. Pat. No. 3,575,156. The Hosford device is a pre-packaged unit made of charcoal, also having a grill. This unit is packaged and intended for single, disposable use. Yet another type of pre-packaged device is found in the 1986 Patent issued to Pratt, U.S. Pat. No. 4,627,854. The self-contained log fire starting kit of Pratt comprises a cardboard carton which is set alight by igniting paper wads, which in turn start kindling strips and finally logs. Beeson (U.S. Pat. No. 4,063,904) disclosed a self-contained fuel package consisting of wood blocks resting on kindling and ignited by excelsior.

All of these devices, while an improvement over the prior art, have certain drawbacks. For example, the Hosford charcoal is difficult to light even under the best of circumstances. The volatile fuel required to light the Beeson wood blocks can be dangerous and burdensome in their transport to the camp fire site. Similarly, the Pratt device works well under ideal conditions but its utility decreases under damp or wet conditions. If the Pratt device is carried over a distance when it is raining, or if the device is set in the snow, the paper starter fuel used to light the device may become damp and unlightable. All of the prior devices are expensive and require special materials to compose the fuel package. Most are bulky to transport.

It is an object of this invention to provide a self-contained campfire which may be carried to a campsite by a convenient handle and packaging. It is an object of this invention to provide a self-contained campfire which is highly portable and lightweight. It is a still further object of this invention to provide a highly portable self-contained campfire which is inexpensive because it is made of standard scrap wood which is readily available.

It is another and primary object of this invention to provide a highly portable, lightweight, inexpensive campfire which may be ignited under all circumstances. Yet another object of this invention is to provide a fused, portable campfire which is highly reliable and can provide hours of warmth to a camper even under the most inclement conditions. Further and other objects of this device will become apparent upon reading the below described Specification.

BRIEF DESCRIPTION OF THE DEVICE

A portable, fused, self-contained campfire is presented which is inexpensive to manufacture, convenient to carry and extremely reliable. The device is formed in a trapezoidal shape. The center of the trapezoid is an internal combustion area consisting of a fire starter stick connected to an elongated fuse. The fuse protrudes outside of the trapezoidal campfire. Surrounding the firestick is small kindling, which is in turn surrounded by small combustible logs. As the campfire builds from the center starting point, the logs become increasingly larger. Semi-circular logs of approximately 5 inch diameter are placed on the top of the trapezoidal campfire. The unignited campfire is contained by a combustible shrink wrap type material. The entire campfire has a handle attached at its top so that it is highly portable. The campfire may be started by simply lighting the fuse which in turn lights the remaining portions of the campfire.

DETAILED DESCRIPTION OF THE PREFERRED EMBODIMENT

Figure 1:
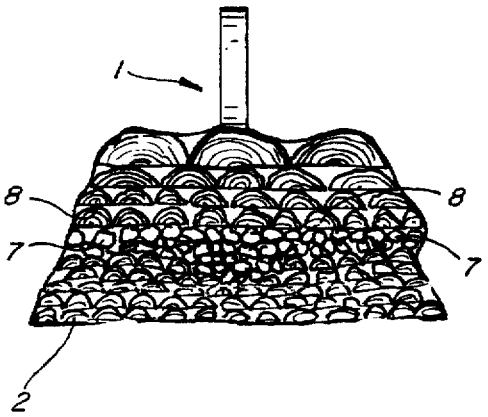
FIG. 1 is an end view of the portable, fused, self-contained campfire.
Figure 3:
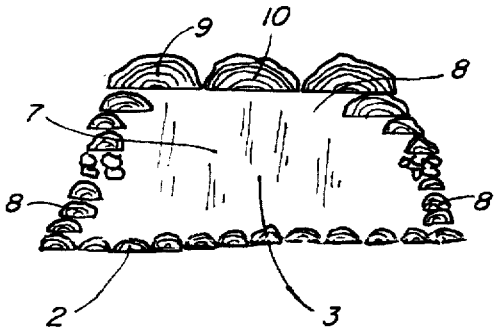
FIG. 3 is a cutaway view of the campfire taken along lines 3—3 of FIG. 2.
Figure 4:
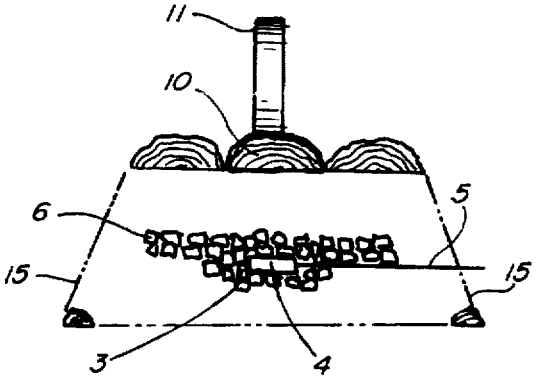
FIG. 4 is a detailed cutaway view similar to FIG. 3, showing the fuse, fire starter stick and small kindling used to initially ignite the fire.
Figure 5:
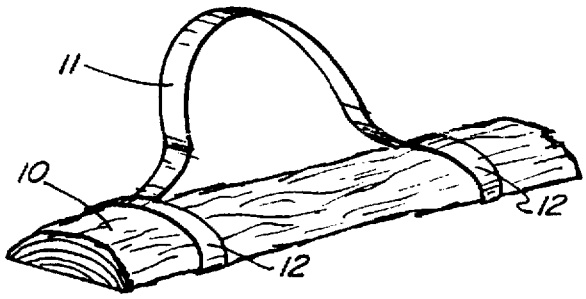
FIG. 5 is a perspective view of the central handle log used to carry the campfire in one embodiment.

A portable, fused, self-contained campfire is presented which may be readily started even under the most inclement conditions. As best shown in FIGS. 1, 3 and 4, the campfire has an essentially trapezoidal shape, with a wood base 2. The trapezoidal campfire 1 is arranged so that an internal combustion area 3 in the center ignites the remaining portion of the campfire.

Utilized as the primary burning fuel in this device is "slab wood". Slab wood consists of the semi-circular outer portions of a log which commonly remain in the lumber industry after the log is cut and shaped into flat sections. These semi-circular logs 2 (in FIG. 1) and 9 (in FIG. 3) have bark on the outside, but have a flat edge (the diameter of the semi-circle). This slab wood base 2 can consist of logs which are approximately 2 inches in diameter. For aesthetic reasons it is desired to find slab wood which has bark on the circular portion of the log so that the campfire will have an outward appearance of a normal log, bark campfire. The logs are arranged on the campfire so that the bark side is facing outwardly, except on the bottom, which is flat.

Figure 2:
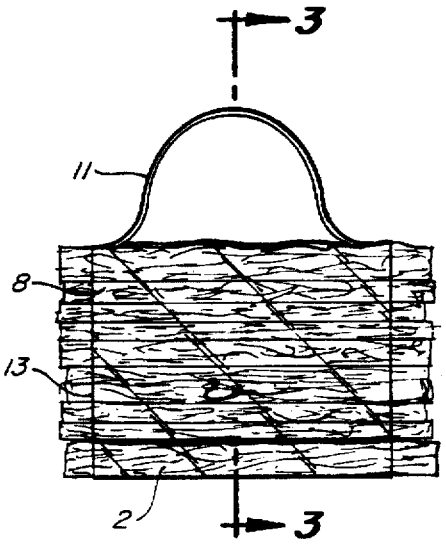
FIG. 2 is a side view of the campfire.

The self-contained campfire package has a trapezoidal cross-section as shown in FIG. 1, with approximately even end edges as shown on FIG. 2. Once the campfire has been assembled, as will be described in the following portion of the Specification, it is surrounded with a shrink wrap 13. The slanted edges 15 of the trapezoid are created by the use of approximately 2 inch slab wood semi-circular logs 8.

Turning now to FIG. 3, the internal combustion portion of the portable, fused, self-contained campfire is shown. Located at the lower central section 3 of the trapezoidal campfire is the main initial combustion material. As shown in FIG. 4, this main internal combustion material comprises a fire starter stick 4 connected to a fuse 5 and surrounded by small kindling 6. This firestick 4 is an essentially rectangular slab of highly combustible material which creates a large amount of heat per cubic inch of material. Firesticks are commonly used to start campfires, barbecues and fireplace fires and are known throughout the industry. The firestick is approximately five inches long by one inch wide and one-half inch thick and is securely connected to the fuse 5.

The fuse 5 may be a cannonball type fuse of the type commonly found in fireworks. The fuse is approximately 15 inches in length and stretches between the centrally located firestick 4 and the outer part of the campfire. The end of the fuse opposite the firestick protrudes out the side edge of the campfire as best shown in FIG. 4. Surrounding the fuse and firestick is small kindling 6. This kindling may be small branches or twigs and is designed to catch fire once the fuse ignites the firestick.

As the internal portion 3 of the campfire is ignited, it in turn ignites the increasingly larger fire logs. Surrounding the firestick 4 and kindling 6 is located a series of intermediate-sized logs 7 approximately one-inch in diameter. These intermediate-sized one-inch logs 7 are in turn surrounded by large-sized approximately two-inch slab wood logs 8 which are generally semi-circular in shape. The large-sized approximately two-inch logs 8 form the outer sides of the campfire as shown in FIGS. 2 and 6.

On top of the self-contained campfire are the largest and longest burning slab wood semi-circular logs 9 and 10. These largest logs 9 and 10 generally have an approximate five inch diameter and will burn for one to two hours under ideal conditions.

As can be seen from the above described arrangement, the easily ignited fuse in turn lights the firestick which in turn ignites the kindling and the increasingly larger fuel supply logs contained in the package. The use of the fuse and firestick, in combination with the configuration and location of the increasingly larger logs, insures that this campfire will light under all conditions.

Figure 6:
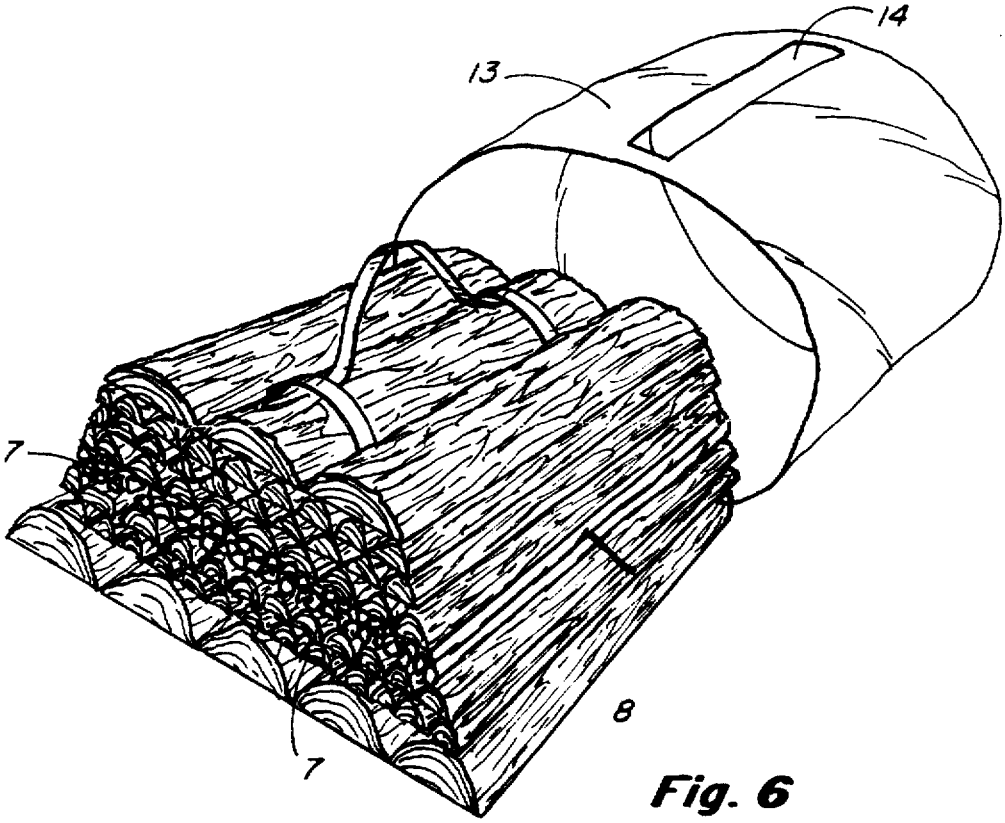
FIG. 6 is a perspective exploded view of the self-contained campfire showing the shrink wrap and campfire in a disassembled condition.

In order to hold the campfire together prior to use, a shrink wrap combustible material shown in FIG. 6 is used. This material 13 is slipped over the campfire 1 and then is contracted until the trapezoidal form shown in FIGS. 3 and 4 can be maintained by the shrink wrap 13. The shrink wrap 13 may have a plastic handle attached to it for ease of carrying.

Alternatively, a central handle log 10, shown in FIGS. 3 and 4, is located on top of the trapezoidal form. This handle log 10 has a combustible handle 11 attached to it by means of combustible loops 12. When the shrink wrap 13 is inserted around the campfire 1, a slot 14 allows the handle 11 to protrude out the top of the shrink wrap, thereby providing a reliable yet combustible handle for carrying the campfire to remote locations.

Since the main fuel utilized in this invention is scrap slab wood, the cost of producing the campfire is kept at a minimum. Due to the use of the fuse and firestick, this campfire will start even under adverse conditions such as are found in the snow and rain. Since the campfire is surrounded by an essentially waterproof yet combustible material, the campfire is kept dry and hence highly combustible even when it is carried or used under adverse conditions such as rain, sleet, or snow.

Although the preferred shape of the campfire is the trapezoidal shape shown in the Drawing Figures, the campfire may also be arranged in a circular or oval cross-sectional pattern while still keeping within the spirit and disclosure of this invention. One key to the invention disclosed herein is the ignition of the campfire by means of the fuse and firestarter stick, surrounded by the small kindling (which is in turn surrounded by increasingly larger pieces of fuel). Although it is desirable to use inexpensive slab wood, other logs, surrounding the kindling in an increasingly larger pattern, may also be utilized in practicing this invention.

Since the slab wood usually has bark on the outside and since the shrink wrap or other material is clear, the campfire has a pleasing aesthetic wood bark look prior to being ignited. Additionally, since larger logs are found at the top of the campfire, the campfire will burn for one to two hours.

Having fully disclosed my invention, I claim:

1. A portable, fused campfire, comprising:

(a) an arrangement of combustible wood with an essentially trapezoidal cross-section, having an internal combustion area located near the lower center of said cross-section;

(b) said internal combustion area comprising a firestick surrounded by small kindling and connected to a fuse;

(c) said fuse having one end connected to said firestick and a second end protruding outwardly from said campfire;

(d) intermediate-sized wood surrounding said small kindling;

(e) large-sized wood surrounding said intermediate wood;

(f) largest semi-circular top wood logs located on the top of said campfire; further comprising (g) a clear, combustible outer shell for maintaining said trapezoidal campfire in said shape, said shell having a handle means for carrying said campfire.

2. A portable, fused campfire as in claim 1, wherein said intermediate-sized wood comprises essentially cylindrical logs having a diameter of 1" to 2".

3. A portable, fused campfire as in claim 2, wherein said large-sized wood comprises essentially semi-circular slab wood having a diameter of 2" to 4".

4. A portable, fused campfire as in claim 3, wherein said largest top wood logs are essentially semi-circular and have a diameter of 5" or more.

5. A portable, fused campfire as in claim 1, wherein said handle means comprises a combustible strap connected to one of said top logs.

6. A portable, fused campfire as in claim 1, wherein said handle means comprises a combustible strap connected to the top of said combustible outer shell.

* * * * *